US007833491B2

(12) United States Patent
Behrens et al.

(10) Patent No.: US 7,833,491 B2
(45) Date of Patent: Nov. 16, 2010

(54) SAMPLE CONTAINER HOLDER

(75) Inventors: Mark Behrens, Bardonia, NY (US); David Landsberger, Caldwell, NJ (US); Francis Gomes, Lincoln Park, NJ (US)

(73) Assignee: Bel-Art Products, Inc., Pequannock, NJ (US)

( * ) Notice: Subject to any disclaimer, the term of this patent is extended or adjusted under 35 U.S.C. 154(b) by 309 days.

(21) Appl. No.: 12/121,911

(22) Filed: May 16, 2008

(65) Prior Publication Data

US 2009/0285723 A1 Nov. 19, 2009

(51) Int. Cl.

| | |
|---|---|
| ***B01L 9/00*** | (2006.01) |
| ***B01L 9/06*** | (2006.01) |
| *B65D 85/20* | (2006.01) |
| *A47B 73/00* | (2006.01) |

(52) U.S. Cl. ..... 422/104; 206/443; 211/60.1; 211/74

(58) Field of Classification Search ..... 422/104
See application file for complete search history.

(56) References Cited

U.S. PATENT DOCUMENTS

| | | | | |
|---|---|---|---|---|
| 4,944,924 | A | 7/1990 | Mawhirt et al. | |
| 5,985,219 | A | 11/1999 | Lind | |
| 6,274,092 | B1 * | 8/2001 | Itoh | 422/104 |

* cited by examiner

*Primary Examiner*—Jill Warden
*Assistant Examiner*—Jennifer Wecker
(74) *Attorney, Agent, or Firm*—Lowenstein Sandler PC

(57) ABSTRACT

The present invention provides a sample container holder for securely holding sample containers of various shapes and sizes. The holder comprises a base having at least one slot extending from an upper portion of the base to a lower portion of the base. The holder further comprises at least one retainer inserted into the slot creating at least a partial enclosed area on the base to accommodate the sample container.

24 Claims, 15 Drawing Sheets

SAMPLE CONTAINER HOLDER

BACKGROUND OF THE INVENTION

1. Field of the Invention

The present invention relates to a sample container holder, more particularly, to a sample container holder that is capable of securely retaining a sample container and for easily removing the same.

2. Description of Related Art

Sample container holders are known in the art to accommodate sample containers such as test tubes, vials, bottles, cylinders etc. commonly used in laboratories. One such holder 10 is shown in FIGS. 1A and 1B. Note that often the holder 10 is designed with a receiving area smaller than a sample container, for example a test tube 12 is often difficult to insert into the holder 10 or remove it from the holder 10 as illustrated in FIG. 1A. On the other hand, the holder 10 maybe designed with a receiving area larger than the sample container, so that it would provide for easy insertion and/or removal, but do not always ensure that the test tube 12 in fact stands securely in the upright position in the holder 10, as illustrated in FIG. 1B. In other words, the test tube 12 may tilt and cause spilling of the sample, which may be hazardous chemicals. This is particularly important in order to prevent any spilling from the test tube 12. As a result, it appears that the sample container holders need to be designed according to the shape and size of each of the sample containers, which can be very time consuming and expensive.

Thus, in order to overcome the disadvantages of the prior art, there is a need in the art to provide a sample container holder that would securely accommodate sample containers of various sizes and shapes. There is also a need in the art of a holder that would provide for insertion and removal of the sample containers without much effort. There is further need in the art of a holder that would provide for insertion and removal of the sample containers with the use of only one hand.

SUMMARY OF THE INVENTION

The present invention provides a sample container holder for accommodating sample containers of various shapes and sizes.

In one embodiment of the present invention, the sample container holder comprises a base having at least one slot and at least one retainer inserted at least partially into the slot in a position substantially perpendicular to the base for accommodating at least one sample container.

In another embodiment of the present invention, the sample container holder comprises a base having an upper portion and a bottom portion and at least one retainer permanently attached to the upper portion of the base in a position substantially perpendicular to the base to accommodate said container.

In a an another embodiment of the present invention, the sample container holder comprises a base having at least one slot, at least first retainer inserted partially into said slot in a position substantially perpendicular to the base, and at least a second retainer permanently attached to the base in a position substantially perpendicular to the base. The first and second retainers are configured to accommodate a sample container.

In a further embodiment of the present invention, the above-mentioned sample container holders further comprise an opening on the base to accommodate the sample container.

BRIEF DESCRIPTION OF THE DRAWINGS

The present invention will he more readily understood from the detailed description of exemplary embodiments presented below considered in conjunction with the attached drawings, of which.

DETAILED DESCRIPTION OF THE INVENTION

The present invention relates to a sample container holder configured to accommodate one more sample containers of various shapes and sizes. The holder is designed to securely and/or firmly hold a sample container in an upright position and further provide easy insertion and removal of the sample container.

Figure 1A:
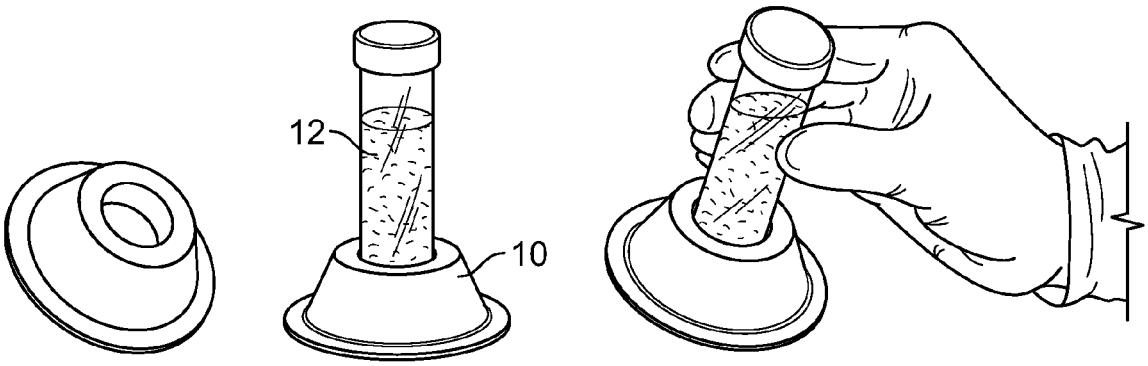
FIG. 1A (Prior Art)
FIGS. 1A and 1B illustrate a sample container holder of prior art.
Figure 1B:
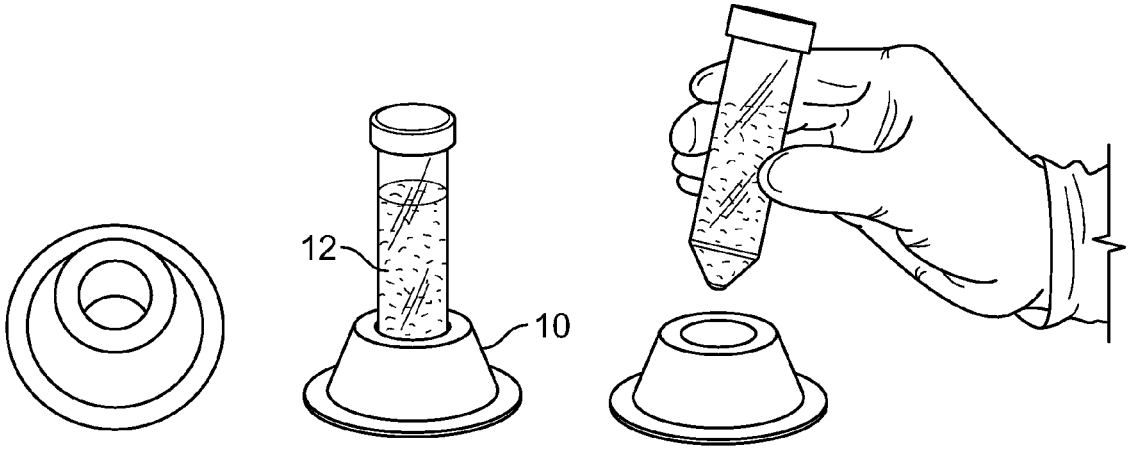
FIG. 1B (Prior Art)
Figure 2A:
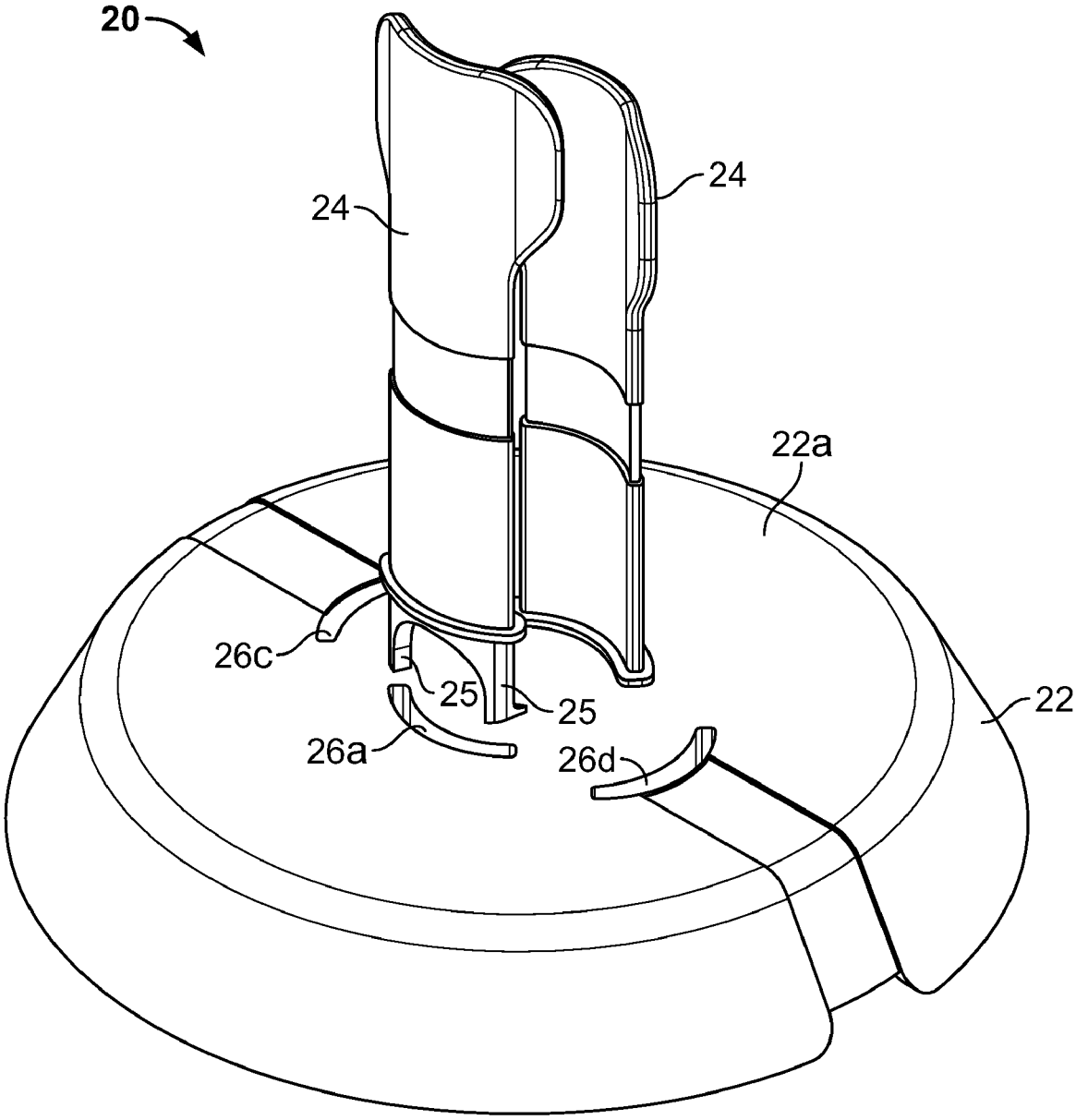
FIGS. 2A and 2B illustrate a sample container holder according to one embodiment of the present invention.
Figure 2B:
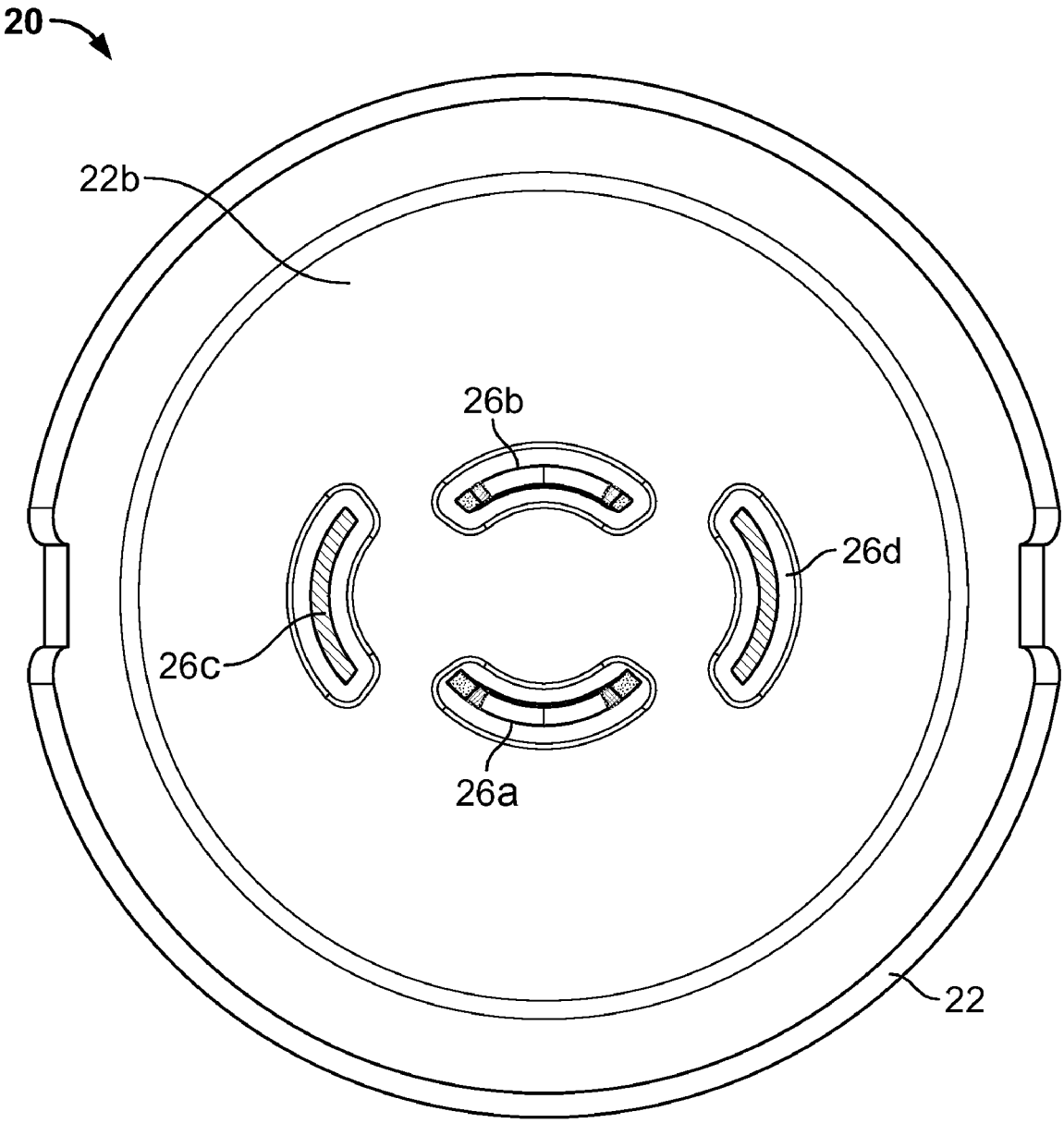

FIGS. 2A and 2B depict an exemplary sample container holder 20 according to one embodiment of the present invention. The sample container holder 20 comprises a base 22 having an upper portion 22*a* and a lower portion 22*b* and a retainer 24. Note that FIG. 2A illustrates the top view of the base 22 and FIG. 2B illustrates the bottom view of the base 22. The base 22 and retainer 24 is preferably made of plastic materials such as PE, PMP, PP, PS etc. However, one skilled in the art would appreciate that the base 22 and the retainer 24 can be constructed of other materials such as wood, fiberglass, metal etc. Note that the base 22 as shown in FIG. 2A and 2B is substantially circular in shape, however, the invention is not limited to a circular form and may comprise of other shapes, such as rectangular, triangular square, etc.

The holder 20 further comprises one or more slots 26 to engage with a retainer. As an example, FIGS. 2A and 2B illustrate four slots 26*a*, 26*b*, 26*c* and 26*d*, however, the base 22 may comprise of fewer or more than four slots. For example, the base 22 may preferably include only one slot 26. As known to one skilled in the art, the slot 26 may extend from the upper portion 22*a* to the lower portion 22*b*, and preferably include an open end to allow the retainer 24 to be inserted from either the upper portion 22*a* or the lower portion 22*b* of the base 22. The retainer 24 is configured to extend perpendicularly to the base 22, Note that two retainers 24 are shown in the exemplary embodiment in FIG. 2A; however, one in ordinary skill can appreciate that the holder 20 can securely hold the container with only one retainer or with more than two retainers.

Figure 2C:
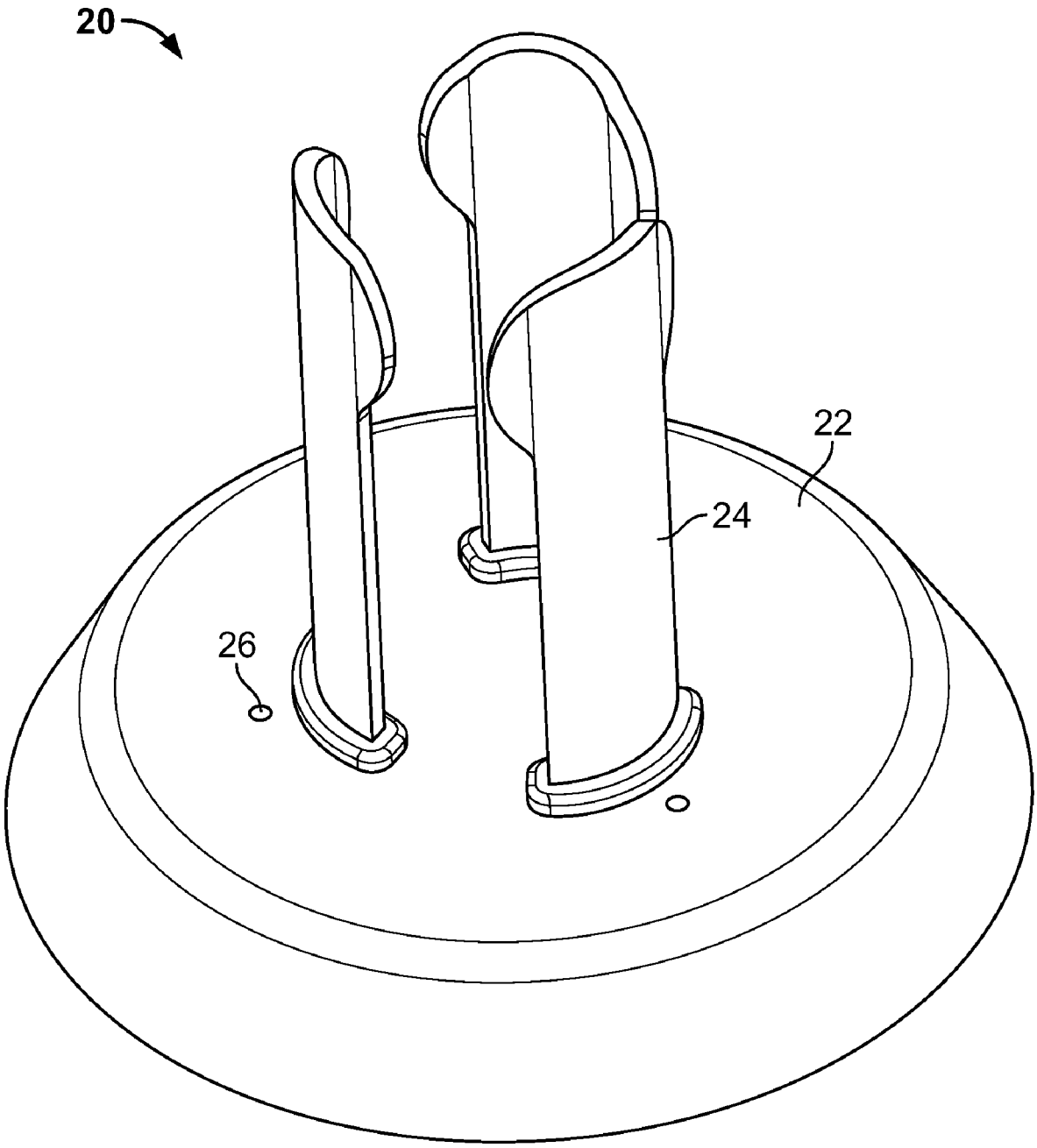
FIGS. 2C, 2D and 2E illustrate sample container holders according to alternate embodiments of the present invention.
Figure 2D:
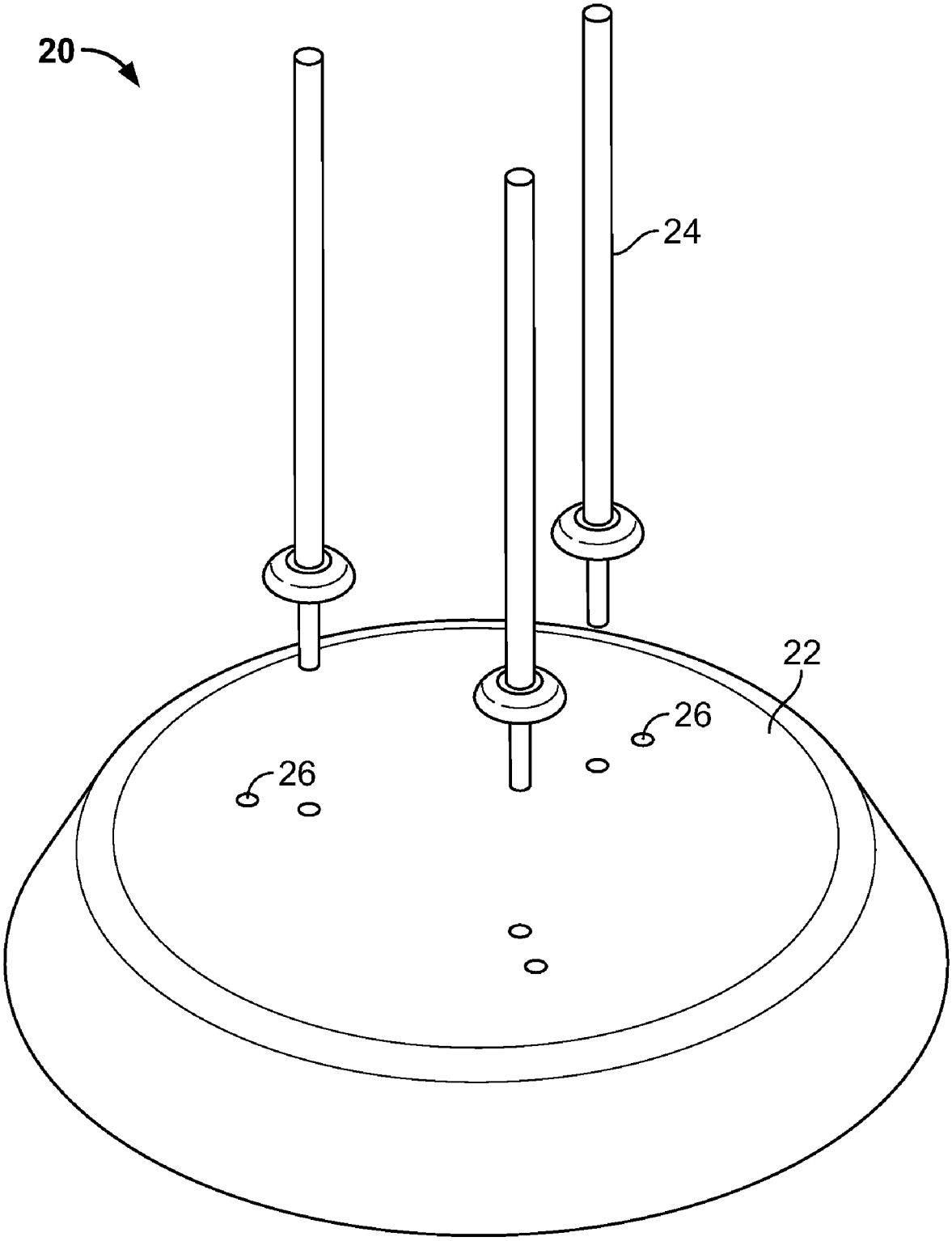
Figure 2E:
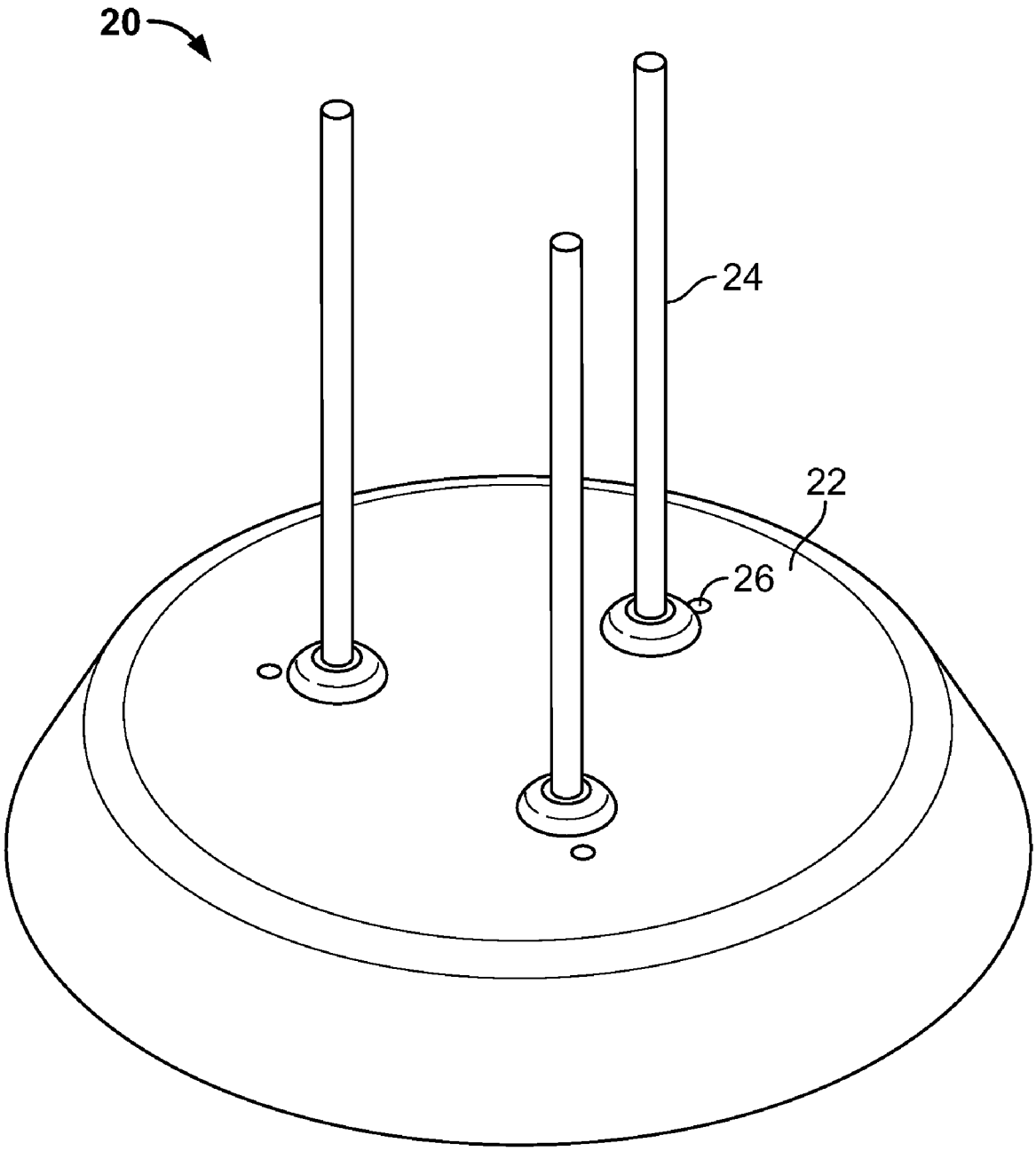

Furthermore, note that in the exemplary embodiment as illustrated in FIGS. 2A and 2B, the slots 26 are positioned to partially surround around the mid-section of the base 22. However, the slots 26 may be formed at different locations of the base 22 and not necessarily positioned to surround the mid-section of the base 22. Although, the slot 26 as shown are substantially semi-circular in shape, one skilled in the art can appreciate that the slot 26 may preferably comprise of other shapes and sizes in order to accommodate retainers of various shapes and sizes. An exemplary embodiment of different number of slots and retainers and various other shapes and sizes of slots and the retainers are shown in FIGS. 2C, 2D and 2E. For example, FIG. 2C, shows pin holes as slots 26 placed at different locations on the base 22 and Her including retainers 24 (for example three) inserted into the pin holes. FIGS. 2D and 2E also illustrate pin holes as slots 26 having retainers 24 sized and shaped as a bar inserted into the pin holes 26*a*.

According to one embodiment of the present invention, the retainer 24 preferably includes one or more tabs 25 to engage with the corresponding slots 26*a* and 26*b* of the base 22, as shown in FIG. 2A. Specifically, the tabs 25 of the retainer 24 are inserted firmly into the slots 26*a* and 26*b*, thereby partially enclosing the mid-section of the base, as shown in FIG. 2A. In this manner, the retainer 24 forms a partially enclosed area 27 and stands securely in an upright position perpendicular to the base 22 thus configured to securely hold the sample container as will be described below. In the exemplary embodiment as illustrated in FIG. 2A, the retainer 24 partially encloses the mid-section of the base; however, as discussed above, based on the design of the slot 26, the retainer 24 may preferably completely enclose the mid-section, or alternatively not form any enclosure.

Figure 2F:
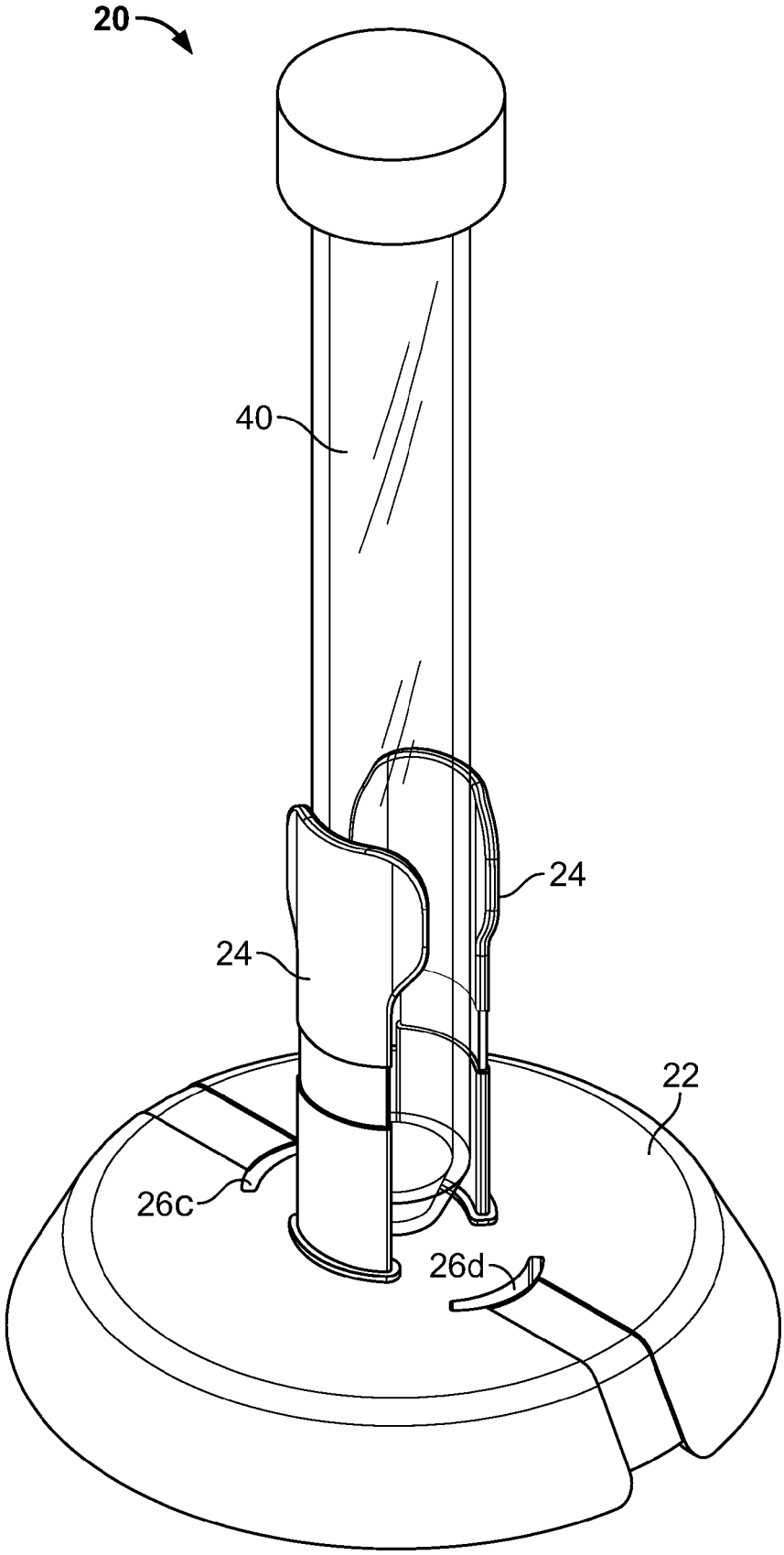
FIGS. 2F and 2G illustrate sample container holder of FIG. 2A having sample containers.

Specifically, the sample holder 20 of the present invention is configured to hold sample containers of various shapes and multiple sizes. For example, as illustrated in FIG. 2F, the retainer 24 is inserted into the slots 26*a* and 26*b* located closer to the mid-section of the base 22 to retain a sample container 40 of a smaller size, for example having a diameter in the range of 10 ml to 40 ml. As shown in FIG. 2F one end 40*a* of the container 40 is securely placed at the bottom of base 22 with at least a portion of the body 40*b* of the container 40 being supported by the retainer 24. Even though, the retainers 24 as shown supports a portion of body of the container 40, one skilled in the art would appreciate that the retainer 24 can be designed to support the entire body of the sample container 24. Note that the container 40 is securely retained by both the base 22 and the retainer 20 perpendicular to the base 22.

Figure 2G:
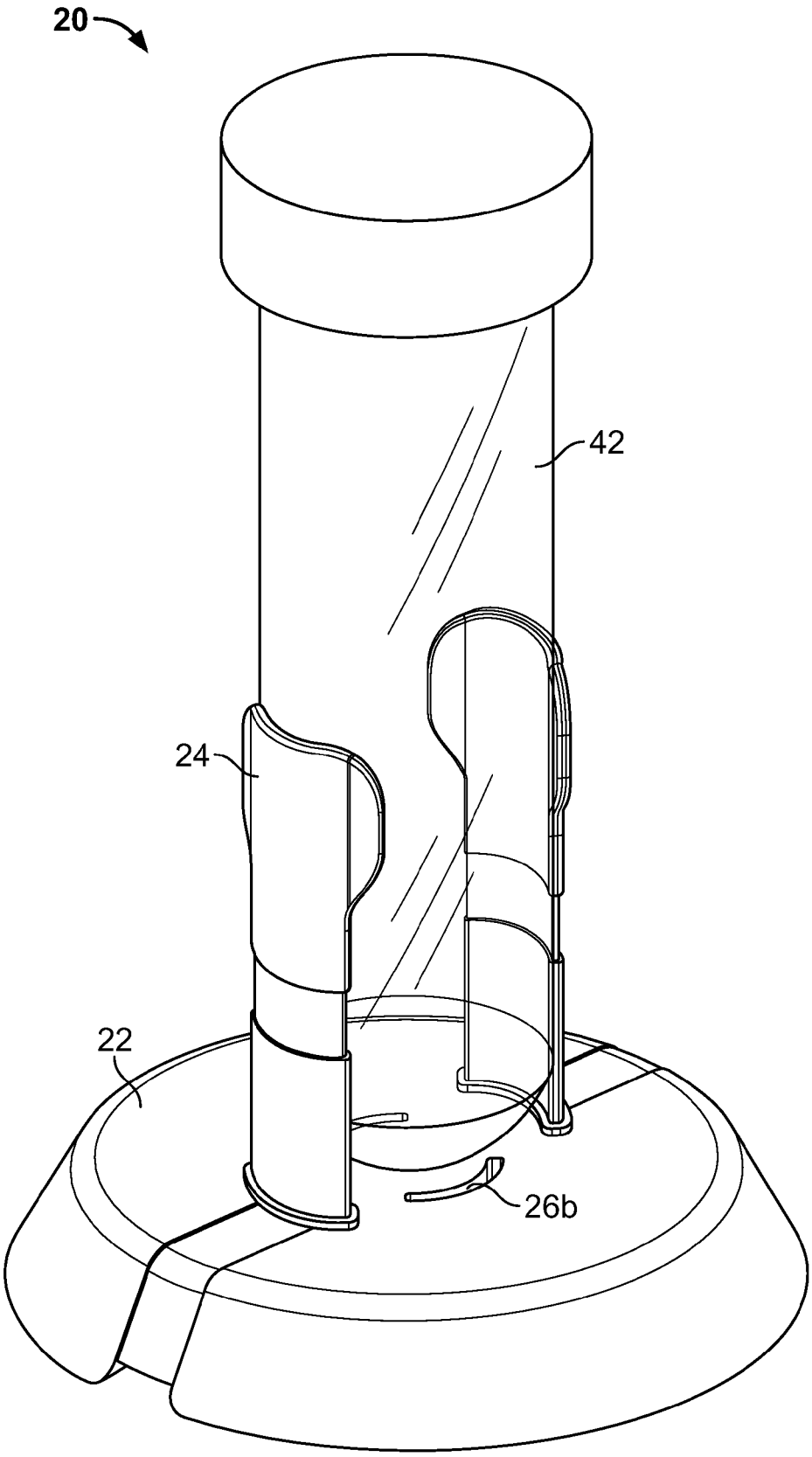

In another example, as shown in FIG. 2G, the retainer 24 is inserted into the slots 26*c* and 26*d* located further away from the mid-section of the base 22 to retain a sample container 42, of a rather larger size, for example, having a diameter in the range of 50 ml to 100 ml or more. As shown in FIG. 2G one end 42*a* of the container 42 is securely placed at the bottom of base 22 with at least a portion of the body 42*b* of the container 42 being supported by the retainer 24. Even though, the retainers 24 as shown supports a portion of body of the container 42, one skilled in the art would appreciate that the retainer 24 can be designed to support the entire body of the sample container 42. Note that the container 42 is securely retained by the base 22 and the retainer 20 perpendicular to the base 22.

In another embodiment of the present invention, the at least one retainer 24 in FIGS. 2A through 20 may be permanently fixed to the base 22 or even one of the retainers 24 may be permanently fixed to the base and the other one inserted into the slot 26 as discussed above.

In accordance with the one embodiment of the present invention, in order to load a sample container 40, into the base 22, a user simply inserts the sample container 40 by simply holding on to the top end of the container 40 and placing its bottom end onto enclosed area 27 formed on base 22 surrounded by the retainers 24. The base 22 including the containers 40 and 42 is illustrated in FIGS. 2F and 2G, respectively. As shown in FIGS. 2F and 2G, the body of the containers 40 and 42 respectively are securely held by the retainers in an upright position. If a user wishes to remove the container from the base 22, he or she may simply hold on to the top end of the containers 40 and 42 and pull them out. Thus, the sample container holder 20 of the present invention, functions to allow easy insertion of the container, firmly supports the sample container in upright position and also provides for easy removal of it.

Although, the exemplary sample container 40 illustrated in FIGS. 2F and 2G described above is a test tube, one of the ordinary skill in the art would appreciate that other sample containers such as a vial, bottle, flask, cylinder, beaker or other types of sample containers typically used in a laboratory environment may be used.

Figure 2H:
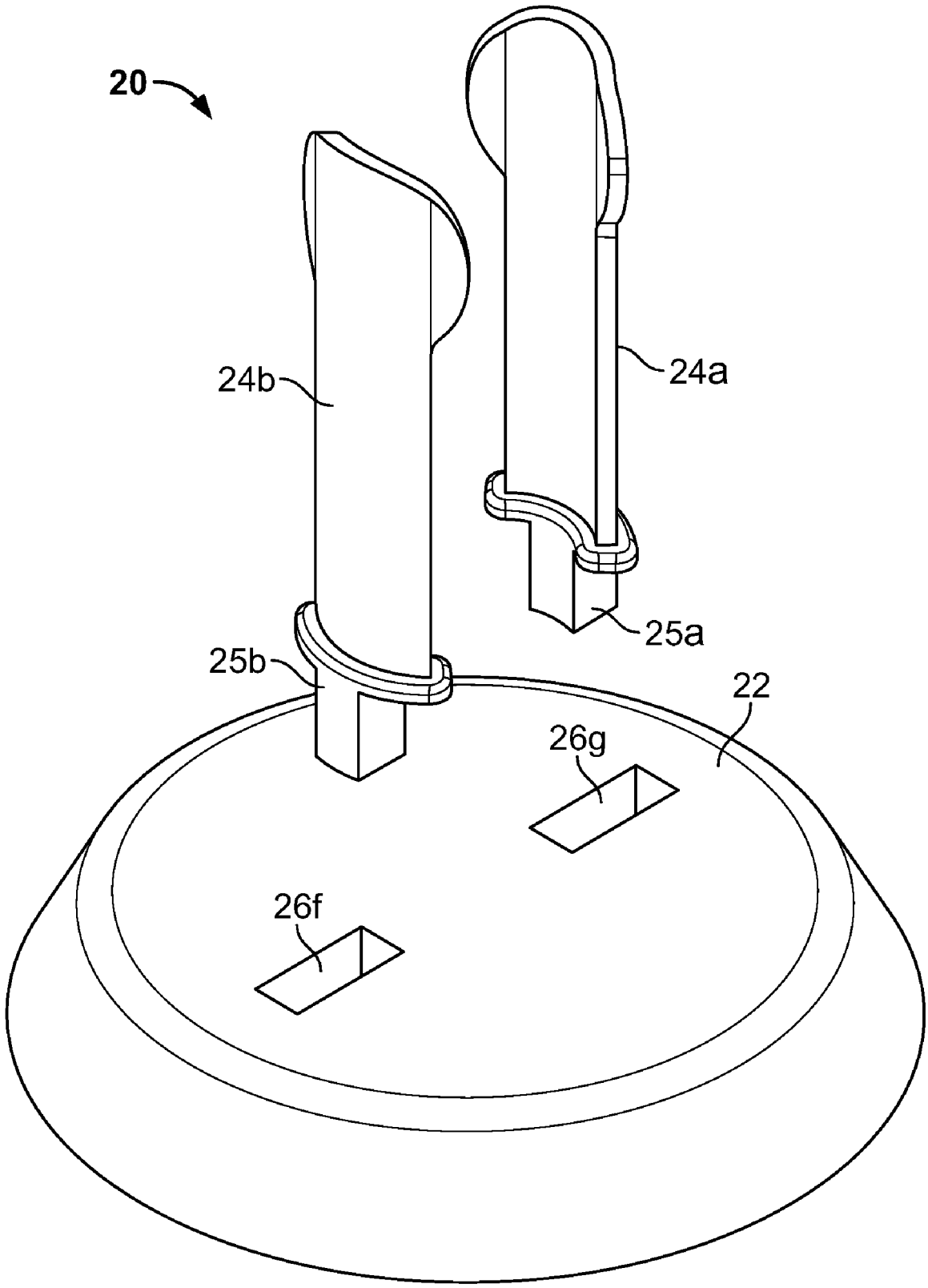
FIGS. 2H, 2I and 2J illustrate sample container holders according to alternate embodiments of the present invention.
Figure 2I:
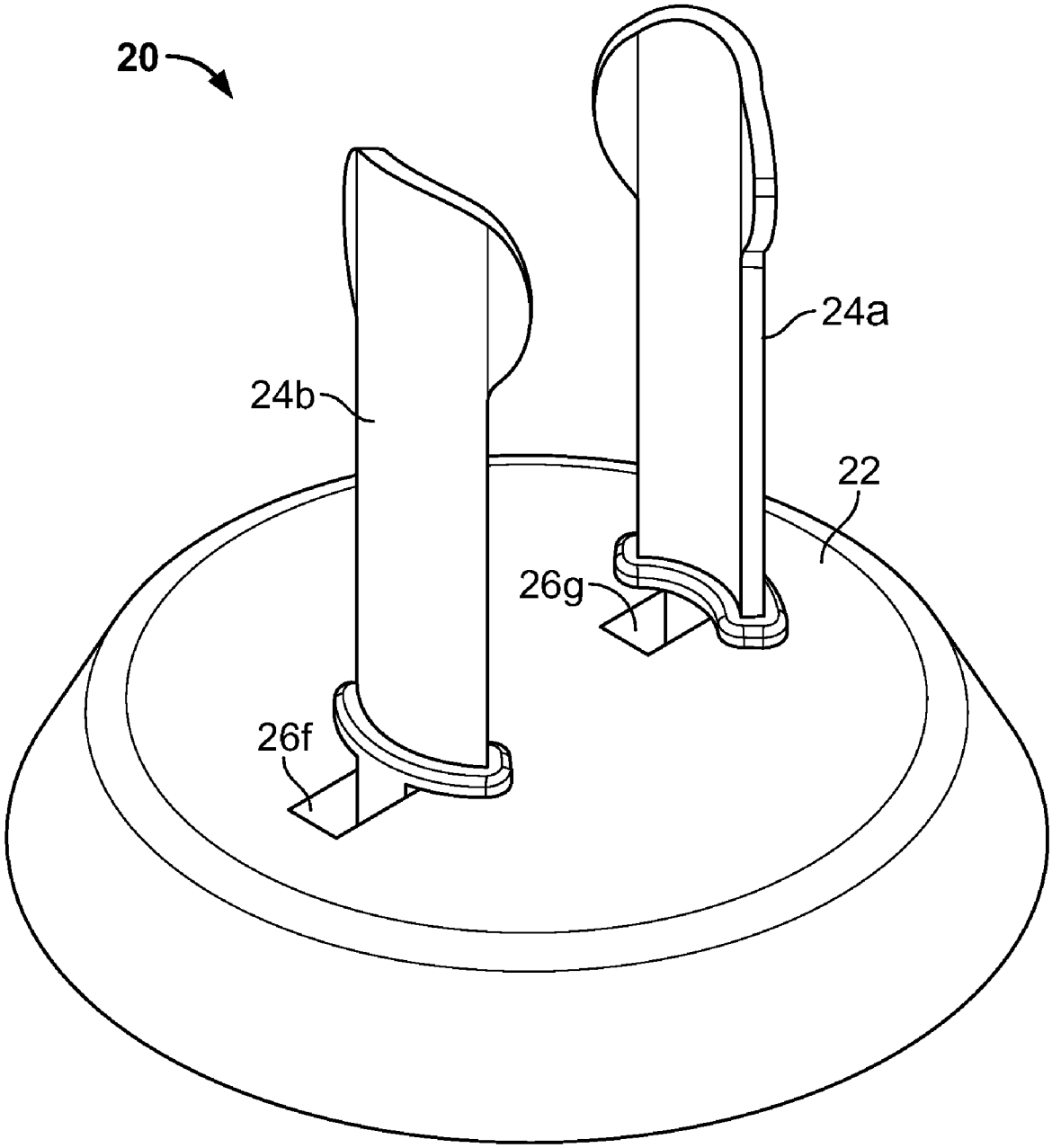
Figure 2J:
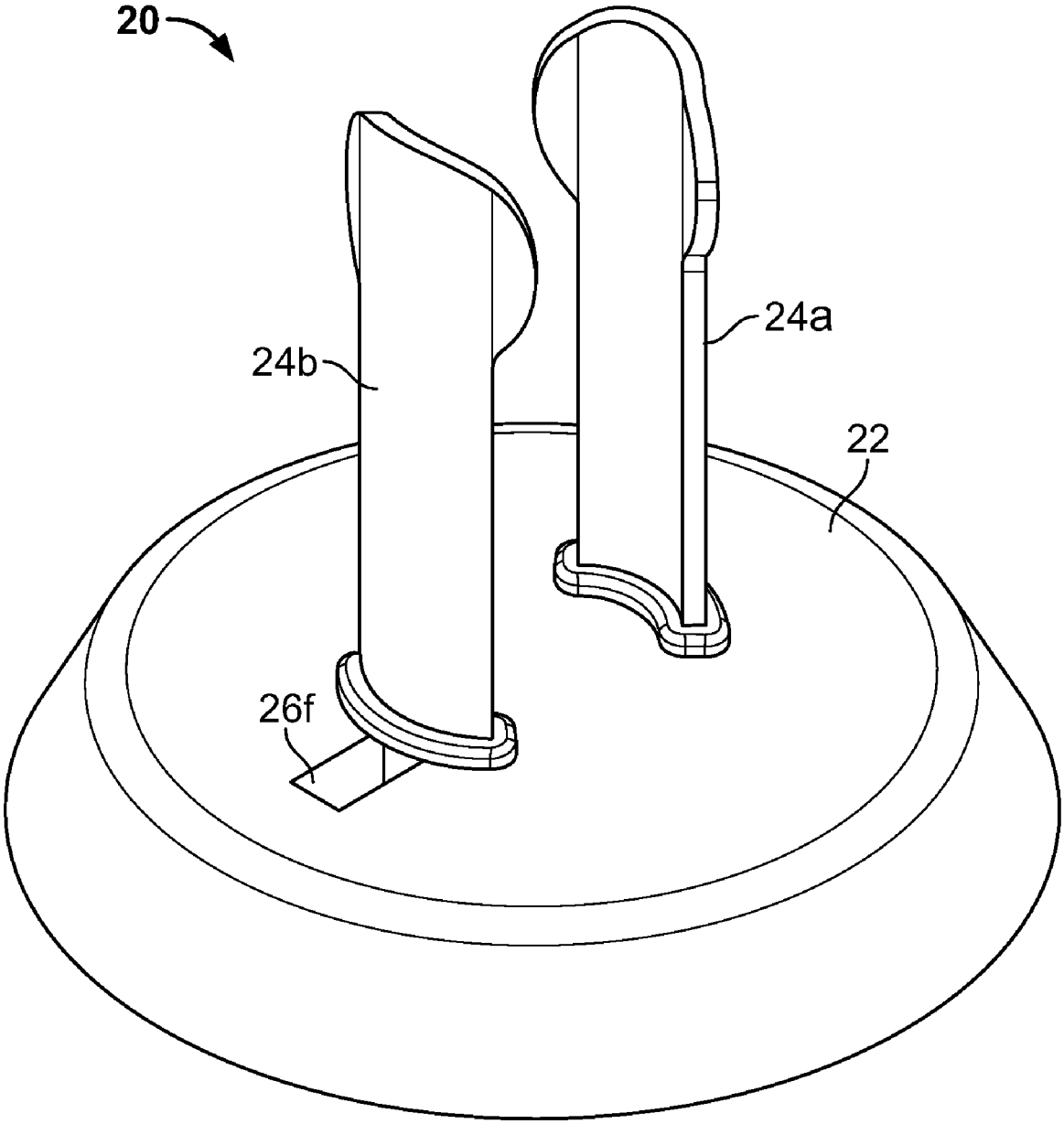
Figure 3A:
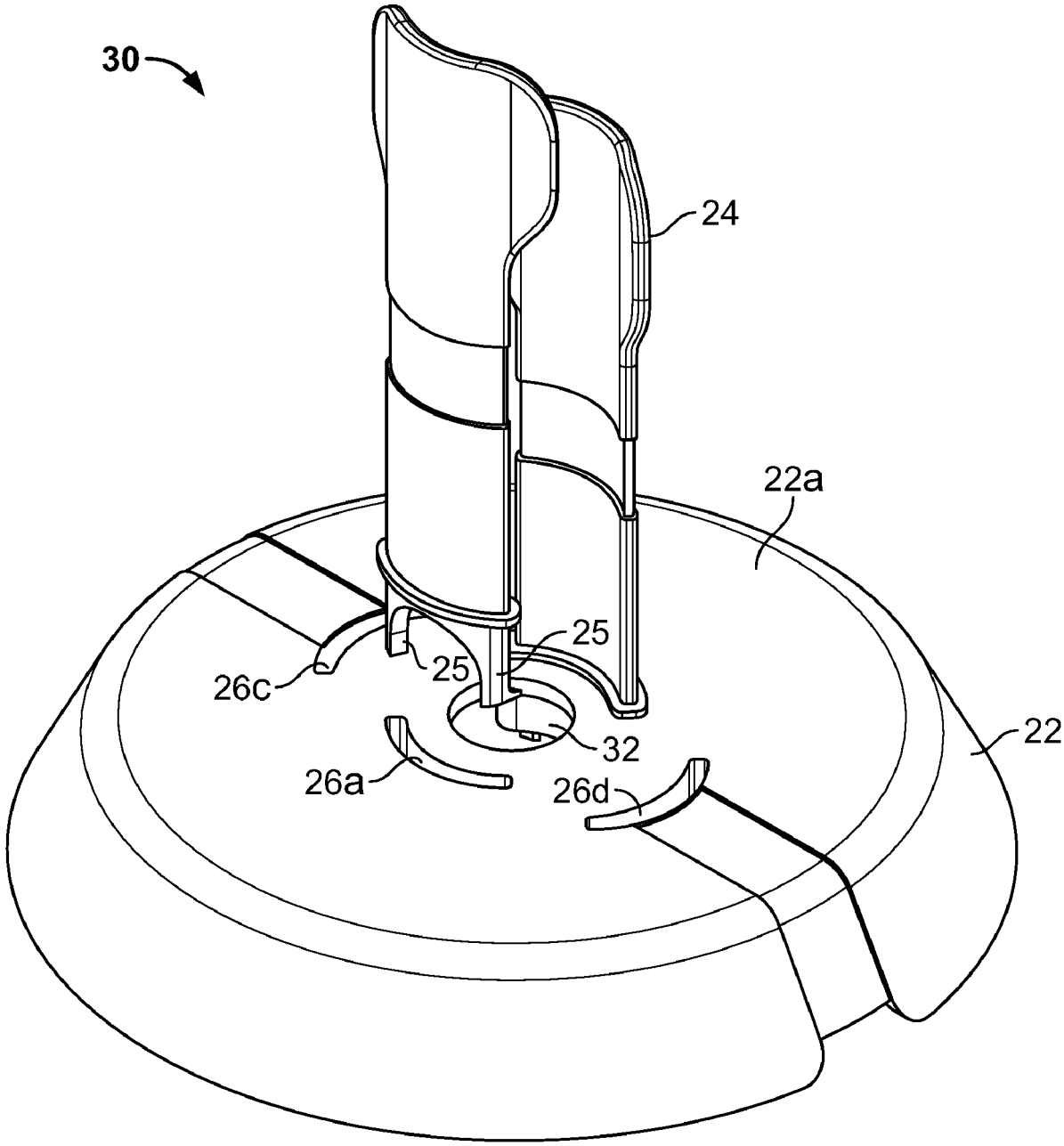
FIGS. 3A and 3B illustrate a sample container holder of FIG. 2A according to another embodiment of the present invention.
Figure 3B:
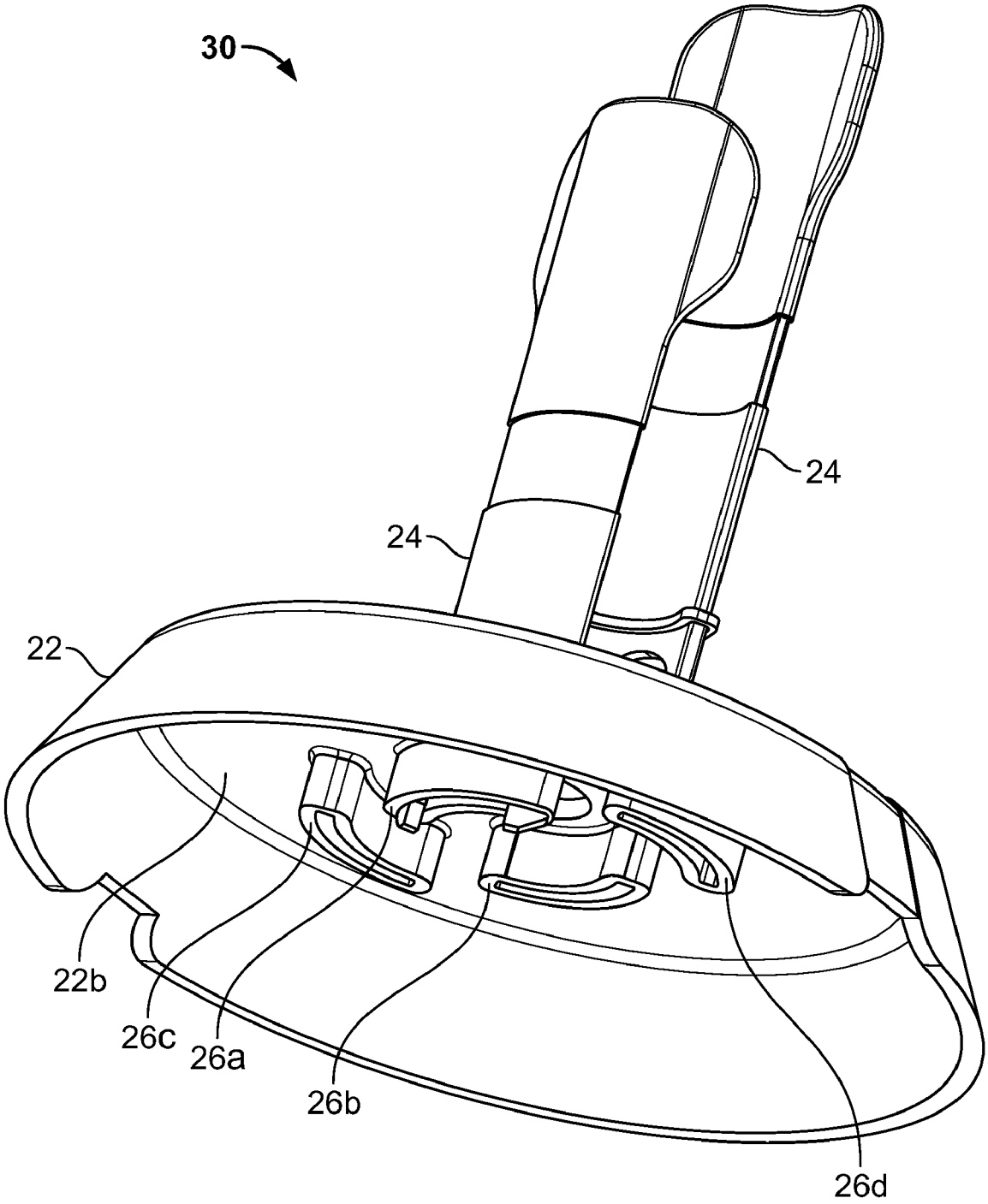

In another embodiment of the present invention, in order to accommodate containers of different shapes and sizes, slot can be designed to provide for movement in one or more retainers. This design of such a slot is shown as slots 26*f* and 26*g* as illustrated in 2H, 2I and 2J of the present application. As illustrated in FIGS. 2H and 2I, the slots 26*f* and 26G are designed to provide some area/space in between for the retainer 24 to easily move from center of the base 22 to outward of the base 22 or vice versa in order to accommodate containers of various sizes. As shown in FIGS. 2H and 2I, a tab 25*a* of a retainer 24*a* is inserted into slot 26*f* and a tab 25*b* of a retainer 24*b* is inserted into slot 26*g*. Both the retainers 24*a* and 24*b* can easily move from the center of the base 22 to the outward of the base or vice versa in their respective slots 26*f* and 26*g*. This provides for flexibility of securely placing and holding the container of different shapes and sizes. Alternatively, the base 22 may preferably contain two different shapes and sizes of the slot 26 as shown in FIG. 2J. In this embodiment, a first retainer 24*a* may preferably be fixed to the base 22. Alternatively, the retainer 24*a* includes one or more tabs (not shown) inserted into a slot (not shown) similar to the slot 26*a* in FIG. 2A or the slot illustrated as pin hole in FIG. 2D. In this configuration, the retainer 24*a* is removable from the base 22. Also, FIG. 2J includes a second retainer 24*b* inserted into a slot 26*g* as shown in FIG. 2H, such that it is removable. The retainer 24*b* is inserted into the slot 26*f* similar to the slot shown in FIGS. 2H and 2I. As discussed above, the retainer 24*b* is movable within the slot 26*f* in order to accommodate containers of various shapes and sizes Referring to FIGS. 3A and 3B, there is shown a sample container holder 30 similar to the holder 20 of FIG. 2A further comprising at least one opening 32, in accordance with another embodiment of the present invention. The opening 32 is adapted to engage with at least one end of the sample container, as described in greater detail below. While, the opening 32 illustrated in FIGS. 3A and 3B is of a substantially circular shape, openings may preferably comprise of other shapes and sized in order to accommodate sample containers of various shapes and sizes. Additionally, the opening 32 as shown in FIGS. 3A and 3B is formed at the mid-section/center of the base, however, the opening 32 can be formed at other locations of the base 22. As discussed above, one skilled in the art can appreciate that the slot 26 may preferably comprise of other shapes and sizes in order to accommodate a retainer of various shapes and sizes.

Although, not shown, the sample holder 30 of FIGS. 3A and 3B may contain different number of slots and retainers, various other shapes and sizes of slots and retainers and other locations of the slots and retainers similar to the ones illustrated in FIG. 2C, 2D and 2E.

As described above, in one exemplary embodiment, the retainer 24 includes one or more tabs 25 to engage with the corresponding slots 26 of the base 22. As shown in shown in FIGS. 3A and 3B the retainer 24 partially encloses the opening 32, however, as discussed above, based on the design of the slot 26, the retainer 24 may preferably completely enclose the opening 42 or alternatively not form any enclosure around the opening 32.

Figure 3C:
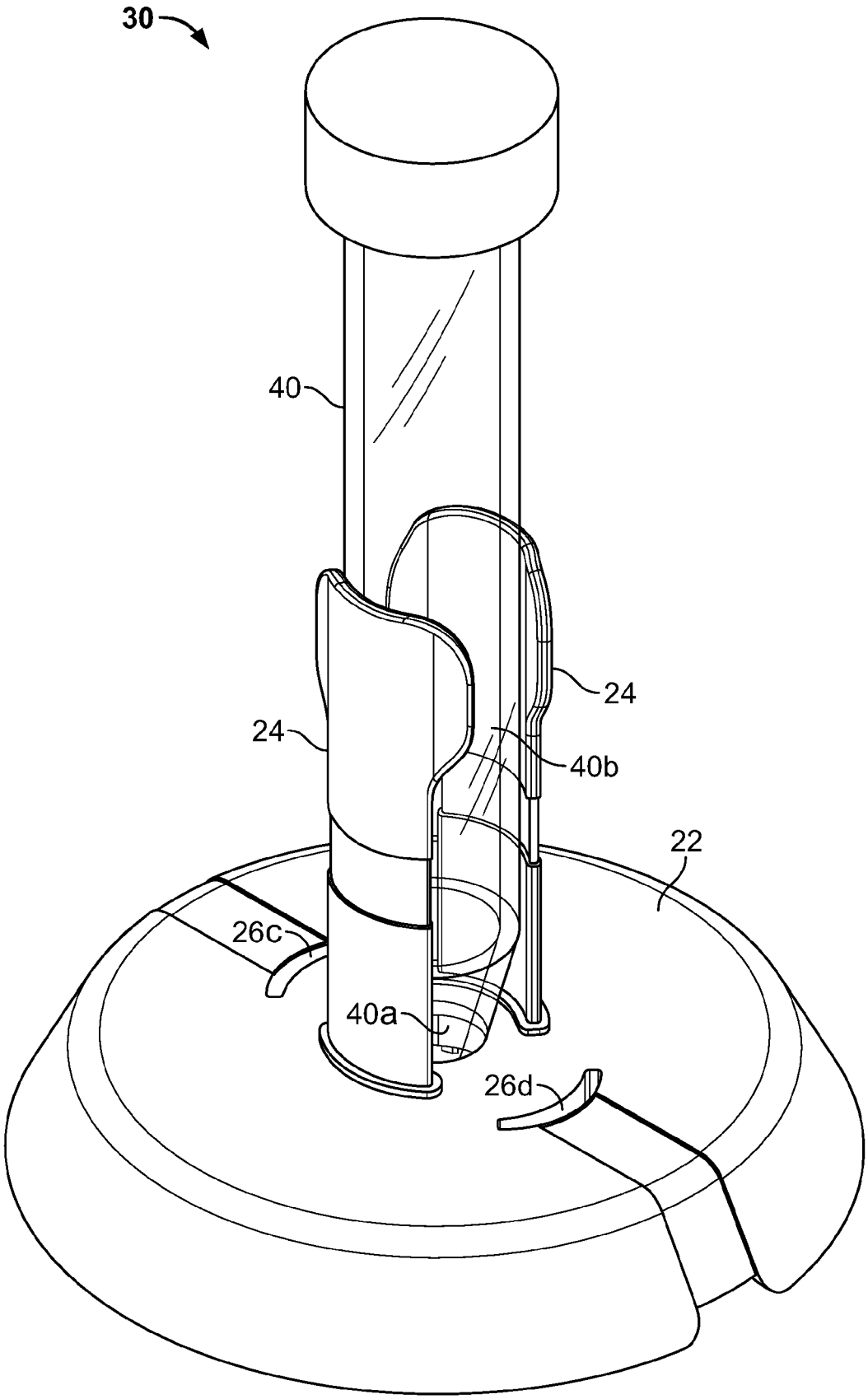
FIG. 3C and 3D illustrate sample container holder of FIG. 3A having sample containers.

According to an embodiment of the present invention, FIG. 3C depicts the sample container holder 20 of FIG. 3A with a sample container 40. In this example, the retainer 24 is inserted into the slots 26*a* and 26*b* located closer to the opening 32 of the base, to retain the sample container 40 of smaller size, for example, having a diameter in the range of 10 ml to 40 ml. As shown in FIG. 3C, the sample container 40, having a flared end 40*a* with a pointed tip is inserted into the opening 32 of the holder 20 with at least a portion of a body 40*b* of the container 40 being supported by the retainer 24. Even though, the retainers 24 as shown supports a portion of body of the container 40, one skilled in the art would appreciate that the retainer 24 can be designed to support the entire body of the sample container 40. Note that the container 40 is securely retained by both the opening 32 and the retainer 20, perpendicular to the base 22.

Figure 3D:
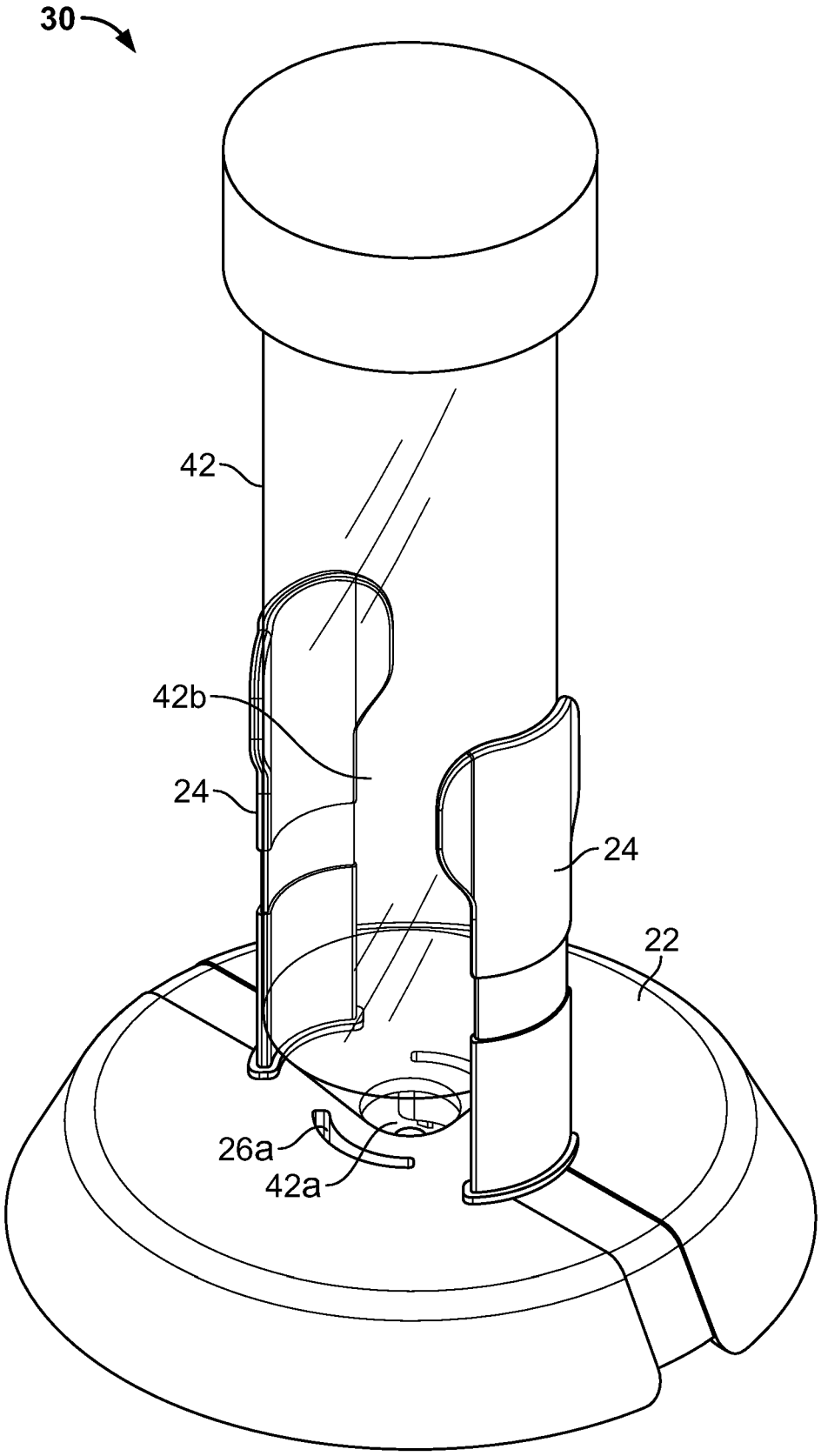

In another example, as shown in FIG. 3D, the retainers 24 are inserted into the slots 26*c* and 26*d* further from the opening 32 of the base 22 to accommodate the container 42 having a diameter in the range of 50 ml to 100 ml. As shown in FIG. 3D, the sample container 42, having a flared end with a pointed tip 42*a* inserted into the opening 42 of the holder 20 with at least a portion of a body 42*b* of the container 42 being supported by the retainer 24 within the partially enclosed area 27. Even though, the retainer 24 as shown supports a portion of body of the container 42, one skilled in the art would appreciate that the retainer 24 can be deigned to support the entire body of the sample container 42. Note that the container 42 is securely retained by both the opening 32 and the retainer 20, perpendicular to the base 22.

In alternate embodiment, the at least one retainer 24 in FIGS. 3A through 3D may be permanently fixed to the base 22 or even one of the retainers 24 may be permanently fixed to the base and the other one inserted into the slot 26 as discussed above.

In accordance with an embodiment of the present invention, in order to load a sample container into the base 22, a user simply inserts the flared ends 40*a* and 40*b* of the containers 40 and 42 respectively into the opening 32 of the base 22. The base 22 including the containers 40 and 42 are illustrated in FIGS. 3C and 3D. As shown in FIGS. 3C and 3D, the body of the containers 40 and 42 is securely held by the retainers in an upright position. If a user wished to remove the container from the base 22, he or she may simply hold on to the top of the container 40 or 42 and simply pull out the flared end from the opening 32. Thus, the sample container holder 20 of the present invention, functions to allow easy insertion of the container, firmly supports the sample container in upright position and also provides for easy removal of the same.

Although, the exemplary sample containers 40 and 42 illustrated in FIGS. 3C and 3D are test tubes, one of the ordinary skills in the art would appreciate those other sample containers such as a bottle, flask, cylinder, beaker etc, typically used in a laboratory environment may be used. Although not shown, the sample holder 20 of FIGS. 3A through 3D may also include slots formed in exemplary embodiments shown in FIGS. 2H, 2I and 2J in order to accommodate containers of different shapes and sizes as discussed above.

Although various embodiments that incorporate the teachings of the present invention have been shown and described in detail herein, those skilled in the art can readily devise many other varied embodiments that still incorporate these teachings without departing from the spirit and the scope of the invention.

The invention claimed is:

1. A sample container holder comprising:

a base having an upper portion and a lower portion;

said base having at least one slot extending from the upper portion to the lower portion to include an open end to accommodate at least one retainer from the upper portion and the lower portion, wherein said retainer is inserted at least partially into said slot in a position substantially perpendicular to the base for accommodating at least one sample container.

2. The holder according to claim 1 wherein said at least one sample container is placed on the base and supported by said retainer in an upright position.

3. The holder according to claim 1 wherein said slot is designed such that the retainer is movable in said slot in order to accommodate said sample containers of various shapes and sizes.

4. The holder of claim 1 wherein said slot surrounds a portion of a base and said at least one retainer forms at least a partially enclosed area around said portion.

5. The holder according to claim 4 wherein one end of the container is placed on the partially enclosed area and at least a portion of a body of the container being supported by said retainer.

6. The holder according to claim 4 wherein said slot is located at a pre-determined distance from the partially enclosed area in order for the retainer to accommodate the container of a specific size diameter.

7. The sample container holder of claim 1 wherein said retainer further comprising at least one tab configured to be inserted into the slot.

8. The holder according to claim 1 further comprising an opening formed on the base.

9. The holder according to claim 8 wherein one end of said container being inserted into said opening and at least a portion of a body of the container being supported by the retainer.

10. The holder according to claim 8 wherein said slot surrounds at least a portion of said opening.

11. A sample container holder comprising:

a base having an upper portion and a bottom portion at least one retainer permanently attached to the upper portion of the base in a position substantially perpendicular to the base to accommodate said container; and an opening extending from the upper portion to the bottom portion of the base to include an open end, wherein said opening is adapted to engage with said container.

12. The holder according to claim 11 wherein said at least one sample container is placed on the base and supported by said retainer in an upright position.

13. The holder according to claim 12 wherein one end of said container being inserted into said opening and at least a portion of a body of the container being supported by the retainer.

14. The sample container holder comprising:

a base having an upper portion and a lower portion;

said base having at least one slot extending from the upper portion to the lower portion to include an open end to accommodate at least one retainer from the upper portion and the lower portion, wherein said at least a first retainer is inserted partially into said slot in a position substantially perpendicular to the base; and said at least a second retainer is permanently attached to the base in a position substantially perpendicular to the base; wherein said first and second retainer are configured to accommodate a sample container.

15. The holder according to claim 14 wherein said at least one sample container is placed on the base and supported by said retainer in an upright position.

16. The holder according to claim 14 wherein said slot is designed such that the retainer is movable in said slot in order to accommodate said sample containers of various shapes and sizes.

17. The holder of claim 14 wherein said slot surrounds a portion of a base and said at least one retainer forms at least a partially enclosed area around said portion.

18. The holder according to claim 17 wherein one end of the container is placed on the partially enclosed area and at least a portion of a body of the container being supported by said retainer.

19. The holder according to claim 17 wherein said slot is located at a pre-determined distance from the partially enclosed area in order for the retainer to accommodate the container of a specific size diameter.

20. The sample container holder of claim 14 wherein said retainer further comprising at least one tab configured to be inserted into the slot.

21. The holder according to claim 14 further comprising an opening formed on the base.

22. The holder according to claim 21 wherein one end of said container being inserted into said opening and at least a portion of a body of the container being supported by the retainer.

23. The holder according to claim 21 wherein said slot surrounds at least a portion of said opening.

24. A sample container holder comprising:

a base having at least one slot; and at least one retainer inserted at least partially into said slot in a position substantially perpendicular to the base for accommodating at least one sample container, wherein said slot is designed such that the retainer is movable in said slot in order to accommodate said sample containers of various shapes and sizes.

* * * * *